US006369340B1

(12) United States Patent
Castonguay et al.

(10) Patent No.: US 6,369,340 B1
(45) Date of Patent: Apr. 9, 2002

(54) CIRCUIT BREAKER MECHANISM FOR A CONTACT SYSTEM

(75) Inventors: Roger Neil Castonguay, Terryville; Randall Lee Greenberg, Granby; Dave Scot Christensen, Harwinton, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/523,249

(22) Filed: Mar. 10, 2000

(51) Int. Cl.[7] ..... H01H 3/00; H01H 9/20; H01H 75/00

(52) U.S. Cl. ..... 200/244; 200/17 R; 200/400; 218/32; 335/16

(58) Field of Search ..... 200/400, 401, 200/17 R, 6 R, 1 R, 11 R, 501, 244, 248, 287, 323–325, 336, 337, 50.01, 50.32–50.35; 218/7, 14, 22, 30–33, 146, 152, 153; 335/8–10, 11, 147, 172, 195

(56) References Cited

U.S. PATENT DOCUMENTS

| | | | | |
|---|---|---|---|---|
| 3,517,356 A | | 6/1970 | Hanafusa | 335/16 |
| 4,220,934 A | | 9/1980 | Wafer et al. | 335/16 |
| 4,255,732 A | | 3/1981 | Wafer et al. | 335/16 |
| 4,259,651 A | | 3/1981 | Yamat | 335/16 |
| 4,409,573 A | | 10/1983 | DiMarco et al. | 335/16 |
| 4,470,027 A | | 9/1984 | Link et al. | 335/16 |
| 4,488,133 A | | 12/1984 | McClellan et al. | 335/16 |
| 4,616,198 A | | 10/1986 | Pardini | 335/16 |
| 4,789,848 A | | 12/1988 | Castonguay et al. | 335/167 |
| 5,029,301 A | | 7/1991 | Nebon et al. | 335/16 |
| 5,281,776 A | | 1/1994 | Morel et al. | 200/144 R |
| 5,313,180 A | | 5/1994 | Vial et al. | 335/16 |
| 5,341,191 A | | 8/1994 | Crookston et al. | 336/16 |
| 5,438,176 A | | 8/1995 | Bonnardel | 200/400 |
| 5,469,121 A | | 11/1995 | Payet-Burin | 335/16 |
| 5,512,720 A | | 4/1996 | Coudert et al. | 200/400 |
| 5,515,018 A | | 5/1996 | DiMarco et al. | 335/16 |
| 5,534,832 A | | 7/1996 | Duchemin et al. | 335/16 |
| 6,087,913 A | * | 7/2000 | Castonguay et al. | 335/16 |
| 6,114,641 A | * | 9/2000 | Castonguay et al. | 200/244 |
| 6,166,344 A | * | 12/2000 | Castonguay et al. | 200/401 |
| 6,218,920 B1 | * | 4/2001 | Reichard et al. | 335/176 |
| 6,239,677 B1 | * | 5/2001 | Ramakrishnan et al. | 335/35 |

FOREIGN PATENT DOCUMENTS

| | | | |
|---|---|---|---|
| EP | 555158 A | 8/1993 | H01H/71/52 |
| FR | 2682531 | 4/1993 | H01H/71/10 |
| WO | 9962092 | 12/1999 | H01H/73/04 |

OTHER PUBLICATIONS

U.S. application No. 09/087,038, R.N. Castonguay, et al., "Rotary Contact Assembly for High Ampere–Rated Circuit Breakers" May 29, 1998.

* cited by examiner

*Primary Examiner*—Michael Friedhofer
(74) *Attorney, Agent, or Firm*—Dave S. Christensen; David Arnold

(57) ABSTRACT

A rotary contact circuit breaker employs a crank to couple a switching mechanism to the rotary contact pole structure. The use of a crank allows for the mechanism and pole structure the individually optimized without effecting the performance of the other. In particular the crank allows for a mechanism that is able to achieve maximum torque delivery to the pole structure.

8 Claims, 5 Drawing Sheets

CIRCUIT BREAKER MECHANISM FOR A CONTACT SYSTEM

FIELD OF INVENTION

The present invention is directed to mechanism for a molded case circuit breaker capable of switching a rotary contact structure between on, off and tripped positions.

BACKGROUND OF THE INVENTION

The present invention is directed to a molded case circuit breaker having a mechanism for switching a rotary contact system between on, off and tripped positions.

U.S. Pat. No. 5,281,776 ('776) describes a molded case circuit breaker having a toggle type mechanism for switching a rotary contact system. This mechanism utilizes a lower linkage that directly attaches to a drive shaft which extends through and rotates the contact system, as is shown in FIG. 1. A crank attached to the same drive pin is used to drive another pin that also extends through the contact system. Since the drive shaft passes through the contact system, optimum positioning of this shaft may not be possible which may cause geometric constraints on how much force can be transferred from the switching mechanism to the rotor. This often limits the performance level that a circuit breaker which uses the '776 switching mechanism is able to achieve.

Therefore, it is desirable to optimize the switching mechanism to transmit an increased amount of force to a rotary contact system.

It is also considered desirable in conjunction with the improved switching mechanism to describe an interface between the mechanism and the contact system that allows for flexibility in the placement and design of the mechanism.

SUMMARY OF INVENTION

In accordance with the present invention a circuit breaker mechanism is provided that comprises a side frame having a cradle attached thereto. A toggle linkage consisting an upper link having a first and second end attaches to the cradle and a lower link attached to the upper link second end by a spring spindle. A crank member attached to the side frame attaches to the lower link. The crank provides the output torque generated by the mechanism.

Also in accordance with the present invention, a first and second shaft extend through a rotor assembly. The first shaft connects with the crank to drive the rotor assembly between a closed and open position in response to a change in state of the circuit breaker mechanism.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
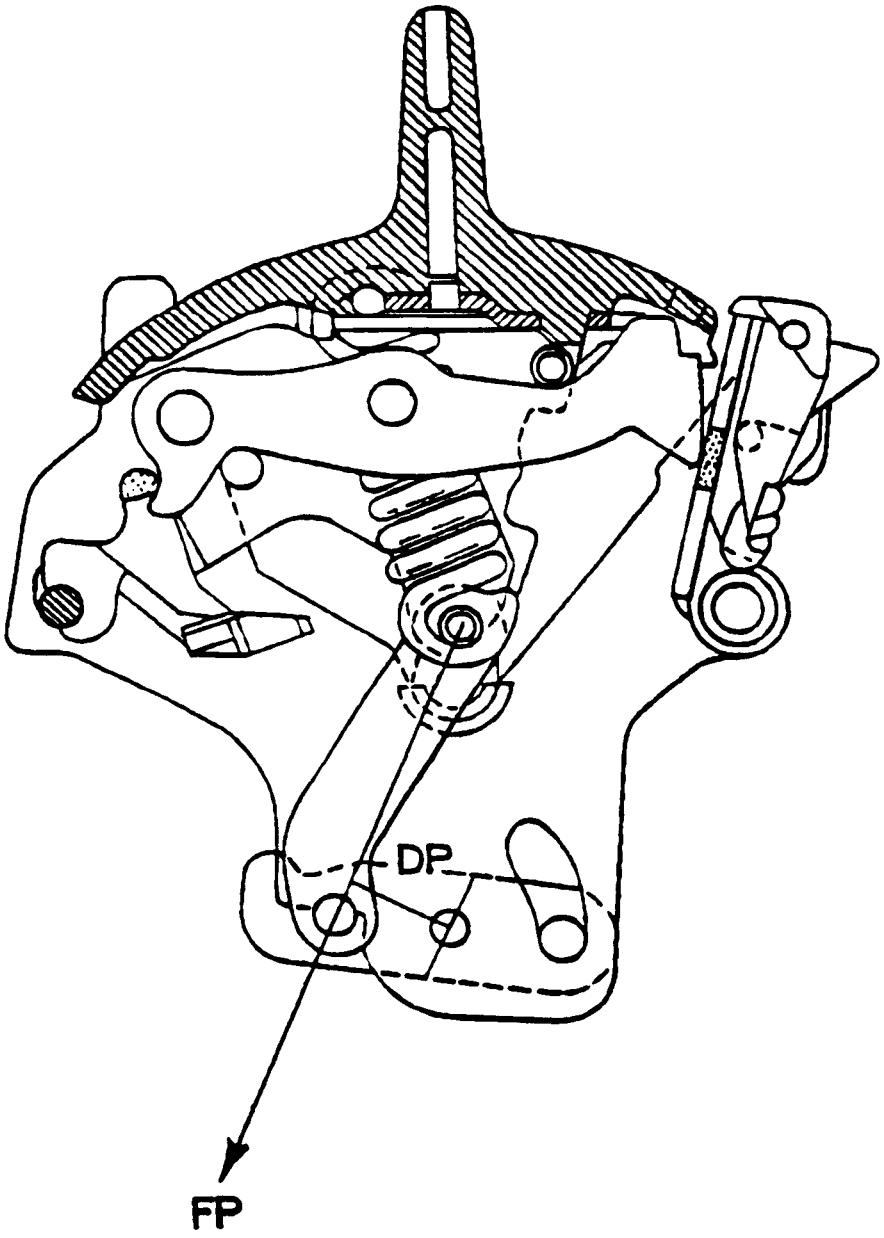
FIG. 1 (PRIOR ART)
FIG. 1 is a cross-sectional view of a prior art mechanism in the closed position.
Figure 2:
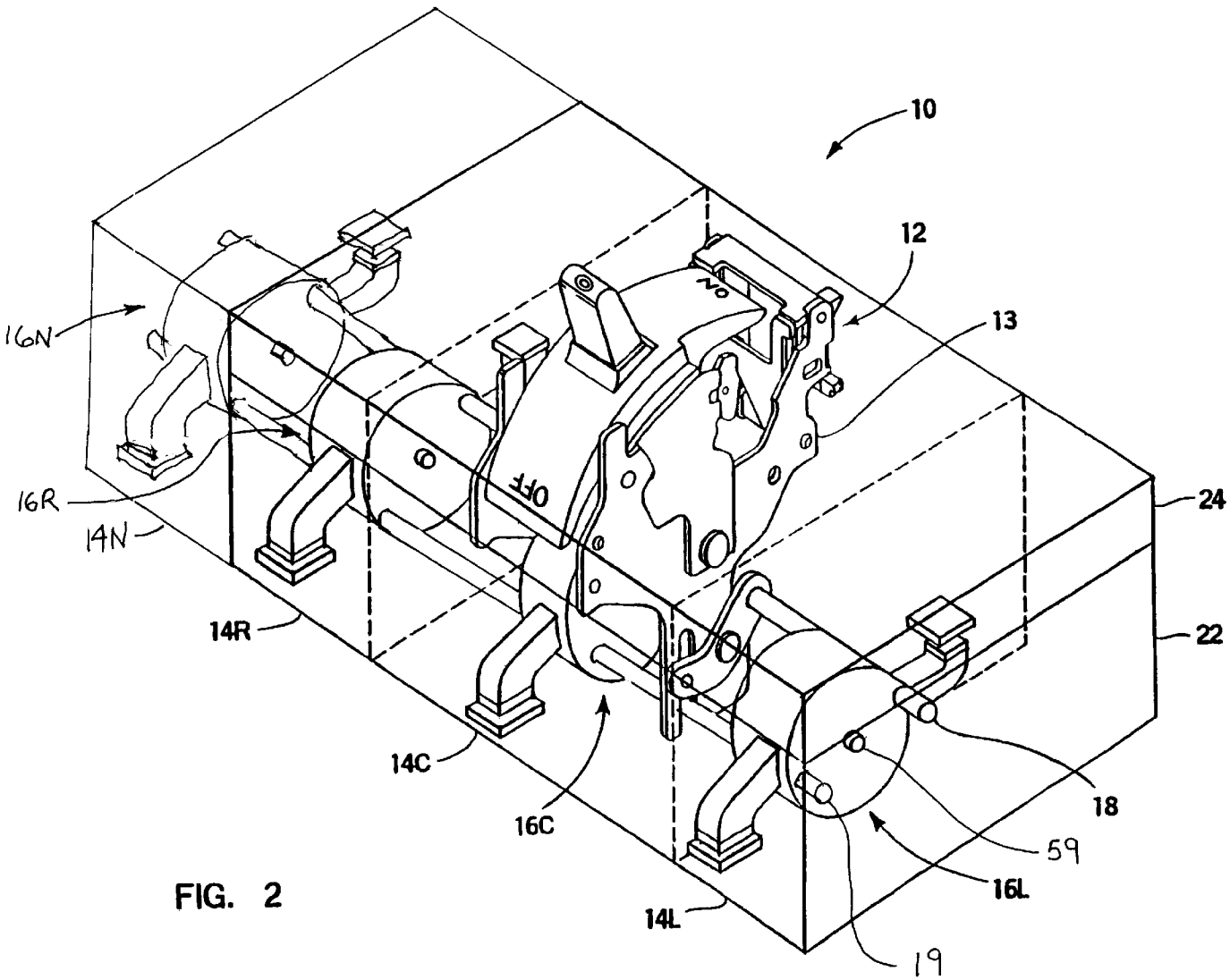
FIG. 2 is a top perspective view of a circuit breaker in accordance with the present invention.

Referring now to FIG. 2,the circuit breaker 10 in accordance with the present invention is comprised of a base 22 and a cover 24. Enclosed within the base 22 and cover 24 are four poles 14C, 14L, 14R, 14N each corresponding to a respective phase in an electrical circuit. Each pole 14C, 14L, 14R, 14N contains a rotary contact assembly 16C, 16L, 16R and 16N respectively, capable of carrying and interrupting electrical current. A drive shaft 18 connects the four poles 14C, 14L, 14R, 16N.

In addition, the center pole 14C is straddled by a mechanism assembly 12. The mechanism 12 connects to the poles 14C, 14L, 14R by the drive shaft 18. The poles 14C, 14L, 14R are operable to move between three positions open, closed, or tripped in response to operation of the mechanism 12.

Figure 3:
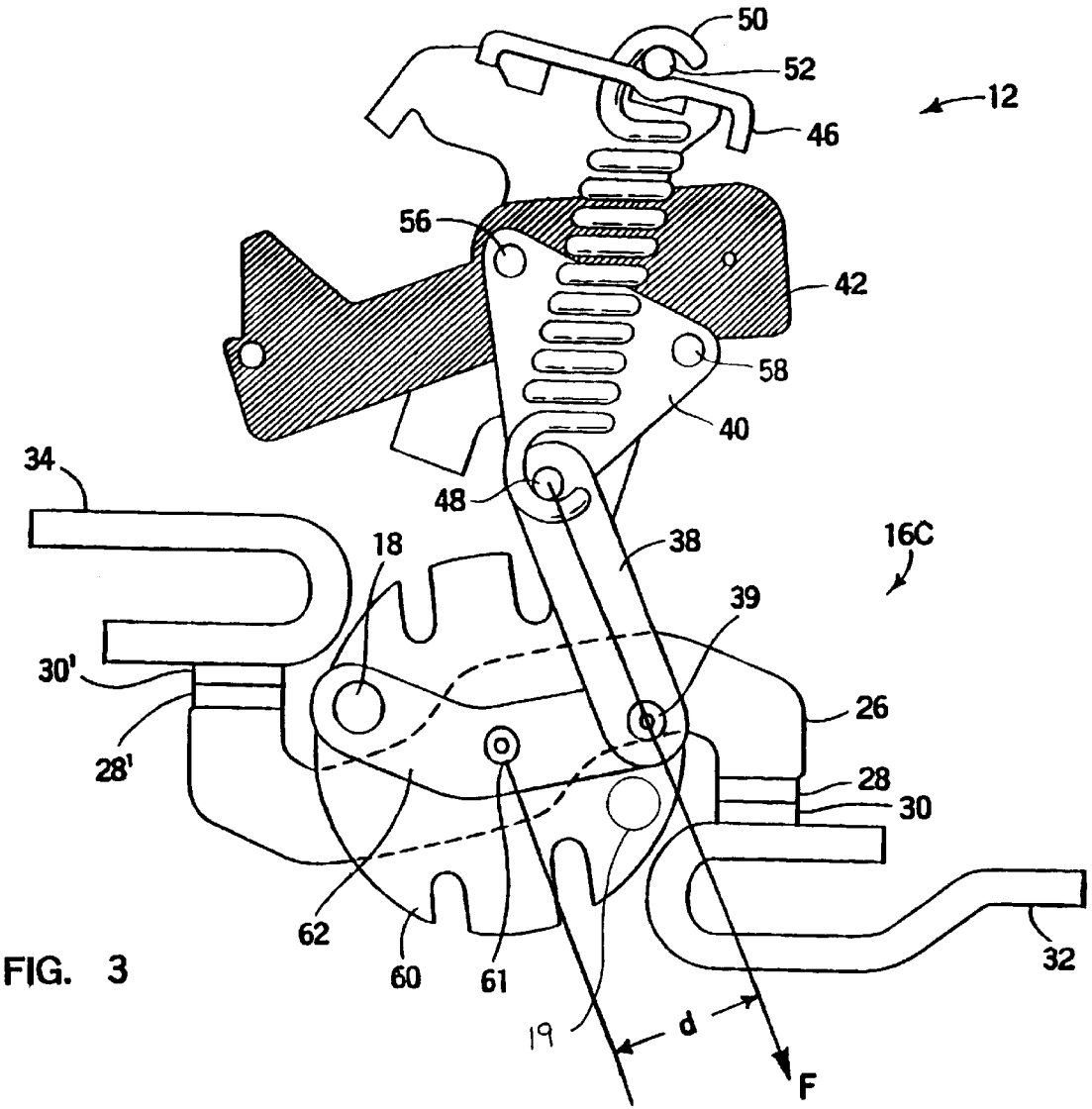
FIG. 3 is a front plan view of the elements of the present invention as illustrated in FIG. 2 in the CLOSED position.

As is seen in FIG. 3, each pole 14 is made up of a rotor 60 housing a contact arm 26, and a pair of movable contacts are 28, 28'. The movable contacts 28,28' mate with the pair of stationary contacts 30, 30' when the mechanism is in the CLOSED position shown. The stationary contacts 30, 30' are brazed or welded to a load strap 32 and line strap 34 respectively. The rotor 60 pivots on a pin 59 which is either supported by an internal wall (not shown), or a modular cassette (not shown) within the base 22. The crank 62 connects the mechanism 12 to the rotor assembly 16C. The crank 62 pivots about the pin 61 which is assembled on the side frames 13. It should be appreciated that the rotor assemblies 16R, 16L, 16N may be identical to rotor assembly 16C. The operation of the rotor assembly 16C operates substantially the same as that described in co-pending U.S. patent application Ser. No. 09/087,038 filed May 29, 1998 which is incorporated herein by reference.

Mechanism 12 consists of a lower link 38 connected to the crank 62 by connector pin 39. The opposite end of the lower link 38 from the crank is connected to an upper link 40 by a spring spindle 48. The upper link 40 in turn is connected to cradle 42 by pin 56, to which is attached to a latch mechanism (not shown). The mechanism spring 50 is connected between the spring spindle 48 and a pin 52 in handle 46. The mechanism 12 is prevented from further counterclockwise rotation when the pin 58 attached to the upper link 40 comes into contact with the cradle 42.

The amount of torque that can be generated by the mechanism 12 is determined by the amount force F transferred from mechanism spring 50 through the lower link 38 and the moment arm. The moment arm is shown in FIG. 3 as the perpendicular distance d. The perpendicular distance d is the length of a perpendicular line from the crank pivot 61 to the line of action of the force F. Since torque is the product of the force F times the distance d, it should be apparent that for a given mechanism, the greater the distance d the more torque is generated. This distance d and thus the torque will be maximized when the distance d is coincident with the connecting pin 39. In the present invention, the pin 39 only connects the lower link 38 to the crank 62. It should be noted that in prior art mechanisms, the pin 39 was also the drive pin that extended through and connected all the rotors.

The components of the rotor assembly 16C often do not allow the drive pin to be placed in this optimal position. For example, as seen in FIG. 3, if the pin 39 is used as the drive shaft to connect all the rotor assemblies, then it would need to pass directly through the contact arm 26. Thus, if an optimized mechanism arrangement is desired, the lower link 38 needs to be decoupled from the drive shaft and the rotor assembly 16C. The present invention accomplishes this by attaching the lower link 38 to a crank 62 which in turn transmits the force to the drive shaft 18. The drive shaft 18 can then be positioned anywhere on the rotor without effecting the amount of torque the mechanism can create. By using the crank 62, either the rotor assembly 16C, or the mechanism assembly 12 may be optimized without compromising the performance of the other, thus allowing for the maximum amount of flexibility in the design of the circuit breaker while still maintaining optimized subassemblies.

Figure 4:
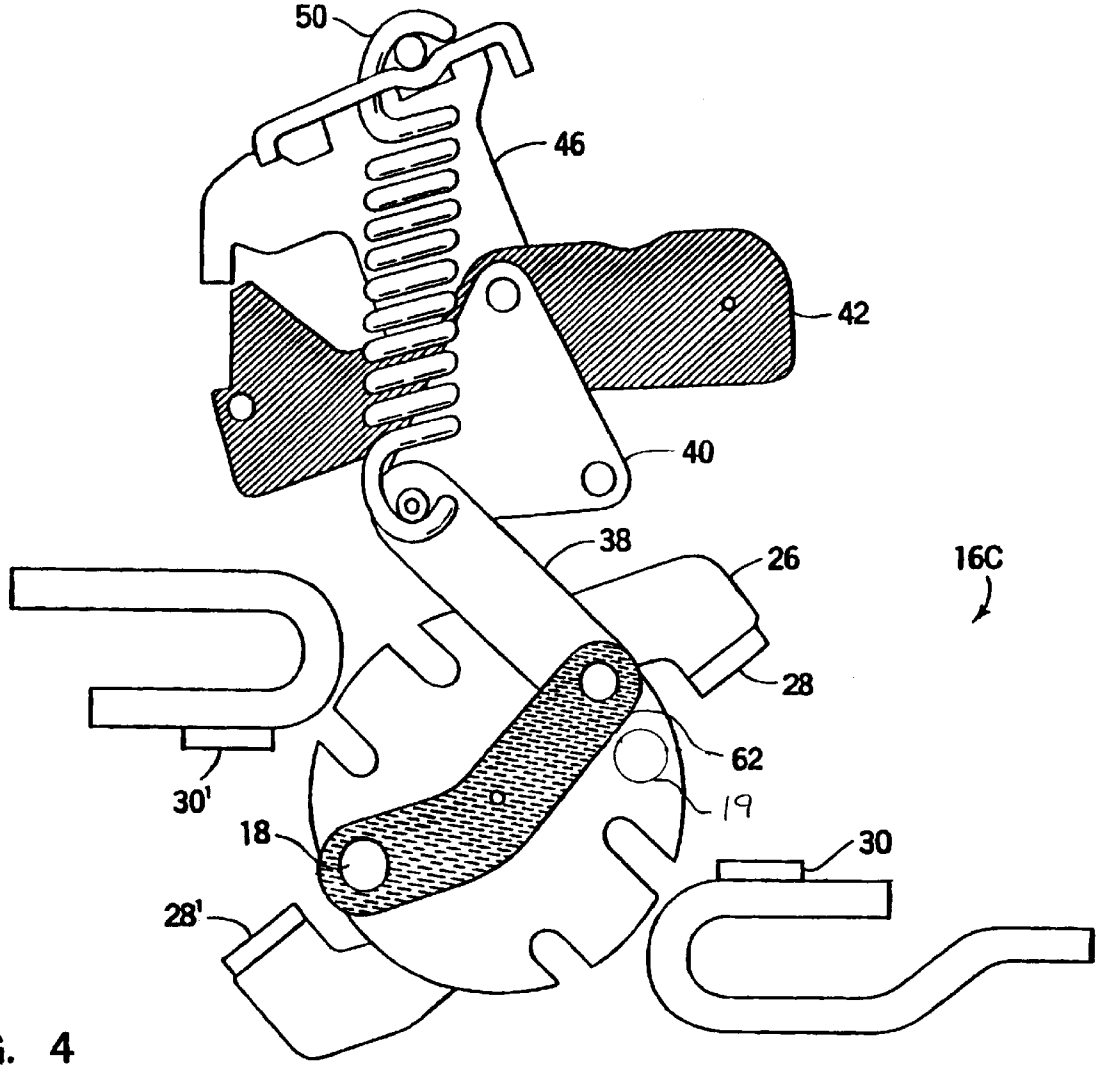
FIG. 4 is a front plan view of the elements of the present invention as illustrated in FIG. 2 in the OPEN position.
Figure 5:
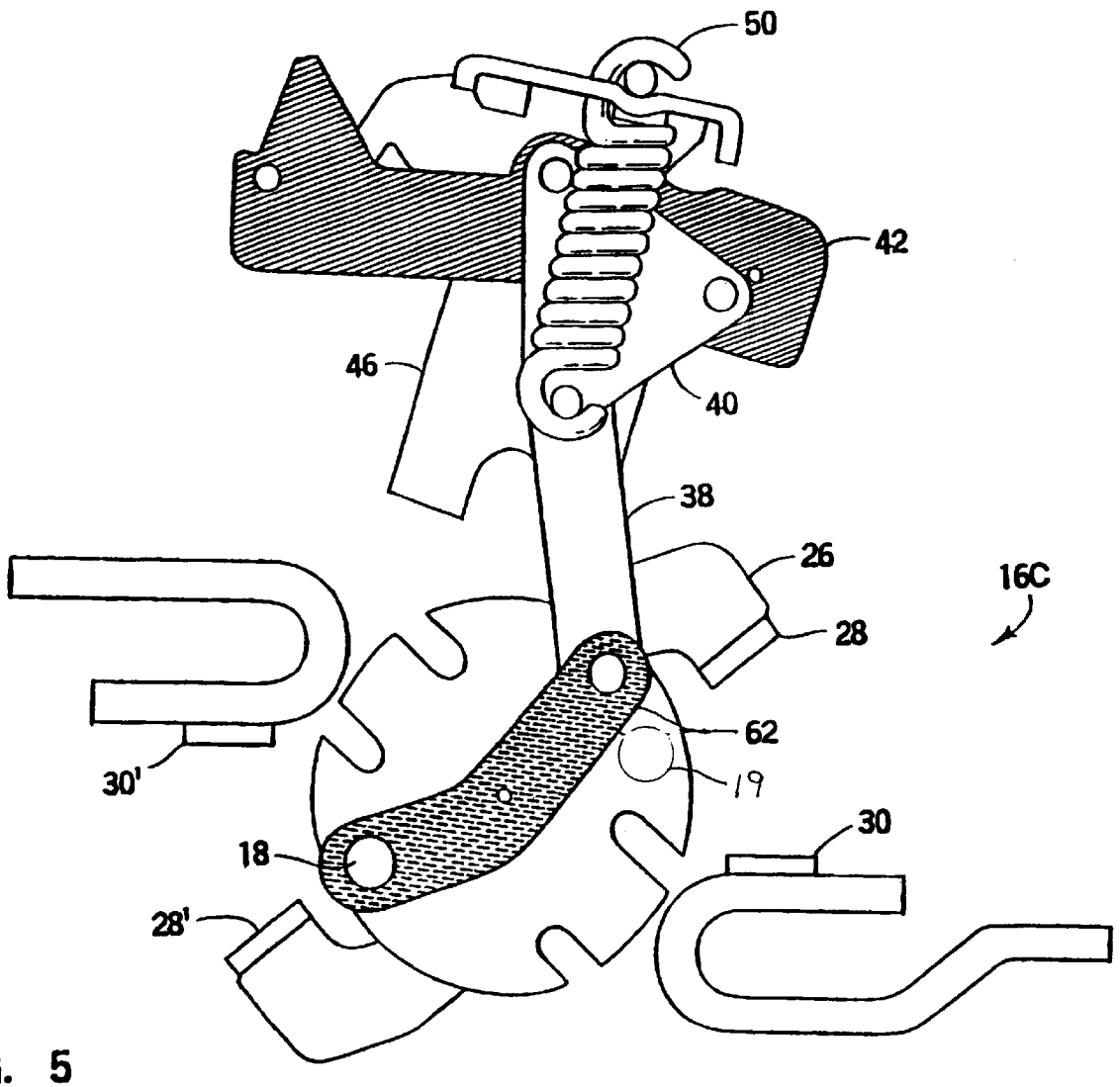
FIG. 5 is a front plan view of the elements of the present invention as illustrated in FIG. 2 in the TRIPPED position.

Referring to FIG. 4, under normal switching operation, the handle 46, is rotated counter-clockwise to switch the circuit breaker 10 from ON to OFF. As the handle 46 is rotated, the line-of-action of the spring 50 will move from the right side to the left side of the pivot 56. This movement "over-centers " the mechanism 12 and the force stored in the spring causes the mechanism 12 to open the rotor assemblies 16C, 16R, 16L, 16N. This opening movement separates the movable contacts 28, 28' from the stationary contacts 30, 30' thereby preventing any flow of current through the circuit breaker 10.

When an abnormal condition is detected by a circuit breaker trip unit (not shown), the latching mechanism (not shown) is released allowing the cradle 42 to rotate in a clockwise direction. The latch and trip unit are similar to U.S. Pat. No. 4,789,848 which is incorporated herein by reference. The resulting movement of the cradle 42 causes the rotor assembly 16C via the upper link 40 and the lower link 38 to rotate separating the movable contacts 28,28' from the stationary contacts 30,30'. The separation of the contacts stops the flow of current through the circuit breaker 10.

It should be appreciated that large loads are applied to the drive shaft 18 by the mechanism 12 and the rotor assemblies 16C, 16L, 16R, 16N when the circuit breaker 10 is in the closed position. These loads tend to either deflect the drive shaft 18, or twist the rotor assemblies 16C, 16L, 16R, 16N. This deflection of the shaft 18 tends to greatly reduce the either the contact depression, or the contact pressure between the stationary contact 30, 30' and the moveable contacts 28, 28 resulting lower than expected performance. To compensate, or correct this bending, a second shaft 19 is added to provide the additional strength.

Referring to FIGS. 2 and 3, shaft 19 is similar to drive shaft 18 in that it extends through and rotationally connects rotor assemblies 16C, 16L, 16R, and 16N. However, shaft 19 is not connected to the crank 62 which allows it to be connected to the rotor assemblies 16C, 16L, 16R, 16N in any convenient location without effecting the optimal crank loading described herein above. Even though the shaft 19 is not attached to the crank 62, significantly greater contact depression has been observed. For example, when the contact depression was measured on a 480V, 600 A industrial circuit breaker, the contact depression with the shaft 19 added was as much as 75% greater in the extreme outer pole 14N than that with only the drive shaft 18.

Although a preferred embodiment of this invention has been described, many variations and modifications will now be apparent to those skilled in the art, and it is therefore preferred that the instant invention be limited not by the specific disclosure herein but only by the following claims.

What is claimed is:

1. A mechanism for a multi-pole circuit breaker comprising:

at least one side frame;

a crank member being attached for rotation to said side frame and having a first and second end;

a first rotary contact assembly mounted for rotation adjacent to said crank; and, a first shaft connected to said crank first end and said first rotary contact assembly, a second shaft positioned apart from said crank second end and connected to said rotary contact assembly.

2. The mechanism of claim 1 further comprising:

a second rotary contact assembly adjacent to said first rotary contact assembly and connected to said first and second shafts.

3. The mechanism of claim 2 further comprising:

a third rotary contact assembly adjacent to said first rotary contact assembly and connected to said first and second shafts.

4. The mechanism of claim 3 further comprising:

a fourth rotary contact assembly adjacent to said third rotary contact assemble and to said first and second shafts.

5. A multipole circuit breaker comprising:

a base;

a first side frame mounted to said base;

a crank member being attached for rotation to said side frame and having a first and second end;

a first rotary contact assembly mounted for rotation within said base adjacent to said crank;

a first shaft connected to said crank first end and said first rotary contact assembly; and, a second shaft positioned apart from said crank second end and connected to said first rotary contact assembly.

6. The circuit breaker of claim 5 further comprising:

a second rotary contact assembly mounted for rotation within said base adjacent to said first rotary contact assembly and a coupled to said first and second shafts.

7. The circuit breaker of claim 6 further comprising:

a third rotary contact assembly mounted for rotation within said base adjacent to said first rotary contact assembly and coupled to said first and second shafts.

8. The circuit breaker of claim 7 further comprising:

a fourth contact assembly mounted for rotation within said base adjacent to said third rotary contact assembly and coupled to said first and second shafts.

* * * * *